US012736041B2

(12) United States Patent
Kakalejcik et al.

(10) Patent No.: US 12,736,041 B2
(45) Date of Patent: Sep. 15, 2026

(54) REFRIGERANT COMPRESSOR

(71) Applicant: Secop GmbH, Flensburg (DE)

(72) Inventors: Jan Kakalejcik, Spisske Vlachy (SK); Stefan Gubo, Jelenec (SK)

(73) Assignee: Secop GmbH, Flensburg (DE)

( * ) Notice: Subject to any disclaimer, the term of this patent is extended or adjusted under 35 U.S.C. 154(b) by 0 days.

(21) Appl. No.: 19/155,328

(22) PCT Filed: Mar. 21, 2024

(86) PCT No.: PCT/EP2024/057674
§ 371 (c)(1),
(2) Date: Aug. 11, 2025

(87) PCT Pub. No.: WO2024/194438
PCT Pub. Date: Sep. 26, 2024

(65) Prior Publication Data

US 2026/0110293 A1 Apr. 23, 2026

(30) Foreign Application Priority Data

Mar. 21, 2023 (EP) ..... 23163268

(51) Int. Cl.
*F04B 39/02* (2006.01)
*F04B 35/04* (2006.01)
(Continued)

(52) U.S. Cl.
CPC ..... *F04B 39/0261* (2013.01); *F04B 35/04* (2013.01); *F04B 39/0094* (2013.01);
(Continued)

(58) Field of Classification Search
CPC .. F04B 39/0261; F04B 35/04; F04B 39/0094; F04B 39/0246; F04B 39/06; F04B 39/121; F25B 31/02
(Continued)

(56) References Cited

U.S. PATENT DOCUMENTS 2,138,664 A * 11/1938 Money ..... F04B 39/0261 417/372
3,560,116 A * 2/1971 Valbjorn et al. ..... H02K 5/12 417/372
(Continued)

FOREIGN PATENT DOCUMENTS

CN 1834414 A 9/2006
CN 102459909 A 5/2012
EP 4 092 271 A1 11/2022

OTHER PUBLICATIONS

International Search Report of PCT/EP2024/057674, mailed May 7, 2024.
(Continued)

*Primary Examiner* — Mark A Laurenzi
*Assistant Examiner* — Benjamin Doyle
(74) *Attorney, Agent, or Firm* — Collard & Roe, P.C.

(57) ABSTRACT

A refrigerant compressor includes a hermetically encapsulated compressor housing, an electric drive unit including a rotor rotatable about an axis of rotation, a stator, and a crankshaft connected to the rotor in a torque-proof manner, a piston-cylinder unit, a lubricant receptacle for conveying lubricant from a lubricant sump vertically via the crankshaft, wherein the crankshaft is partially arranged in a bush-like section of a compressor block, wherein, viewed in radial directions, an interspace is formed between a second stator section and the compressor block, in which interspace a second rotor section is arranged at least partially, wherein, viewed in the radial directions, a gap is formed between the second rotor section and the compressor block. According to the invention, for the lubricant at least one through-hole is provided in the compressor block between the crankshaft and the gap.

14 Claims, 8 Drawing Sheets

(51) Int. Cl.

| | |
|---|---|
| ***F04B 39/00*** | (2006.01) |
| ***F04B 39/06*** | (2006.01) |
| ***F04B 39/12*** | (2006.01) |
| ***F25B 31/02*** | (2006.01) |

(52) U.S. Cl.
CPC ..... *F04B 39/0246* (2013.01); *F04B 39/06* (2013.01); *F04B 39/121* (2013.01); *F25B 31/02* (2013.01)

(58) Field of Classification Search
USPC ..... 417/415, 902; 184/6.5, 6.18, 6.28
See application file for complete search history.

(56) References Cited

U.S. PATENT DOCUMENTS 3,630,316 A 12/1971 Sillano et al.
3,663,127 A 5/1972 Cheers
4,216,661 A * 8/1980 Tojo ..... F04C 29/045 62/505
4,462,772 A * 7/1984 Hazaki ..... F01C 21/04 418/94
4,470,772 A * 9/1984 Gannaway ..... F04B 27/109 417/372
4,473,343 A * 9/1984 Hazaki ..... F04C 29/0021 418/94
4,502,852 A * 3/1985 Hazaki ..... F01C 21/04 418/94
4,609,334 A * 9/1986 Muir ..... F04C 23/008 418/55.6
4,666,381 A * 5/1987 Butterworth ..... F04C 29/023 418/94
4,749,344 A 6/1988 Tomita et al.
4,875,840 A * 10/1989 Johnson ..... F04C 29/023 418/55.6
4,877,381 A * 10/1989 Johnson ..... F04C 29/023 418/94
5,104,302 A * 4/1992 Richardson, Jr. ... F04C 29/0057 418/55.6
5,257,920 A * 11/1993 Takeda ..... F04C 27/005 418/57
5,660,539 A * 8/1997 Matsunaga ..... F04C 29/028 418/94
5,730,588 A * 3/1998 Terai ..... F04C 18/0253 418/55.6
5,980,222 A 11/1999 Fry
6,280,155 B1 * 8/2001 Dreiman ..... F04C 23/008 417/410.5
6,585,496 B1 * 7/2003 Sun ..... F04C 29/028 417/410.5
9,568,000 B2 * 2/2017 Yamada ..... F04B 49/06
2003/0086798 A1 * 5/2003 Tani ..... F04C 29/026 417/366
2007/0217936 A1 * 9/2007 Oh ..... F04C 29/026 418/55.6
2012/0107151 A1 * 5/2012 Yokoyama ..... F04C 29/023 417/366
2019/0190337 A1 * 6/2019 Shono ..... H02K 9/08
2020/0328632 A1 * 10/2020 Radford ..... H02K 1/274
2022/0307504 A1 * 9/2022 Isome ..... F04C 23/008
2023/0065792 A1 * 3/2023 Miguel ..... F04B 39/0246

OTHER PUBLICATIONS

International Preliminary Report on Patentability in PCT/EP2024/057674, mailed Dec. 18, 2024.

* cited by examiner

Fig. 3
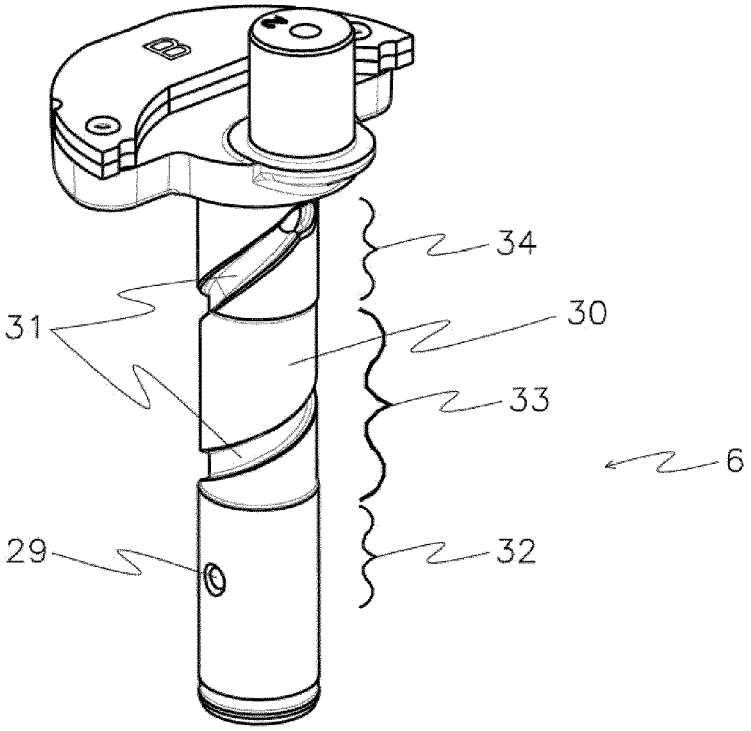
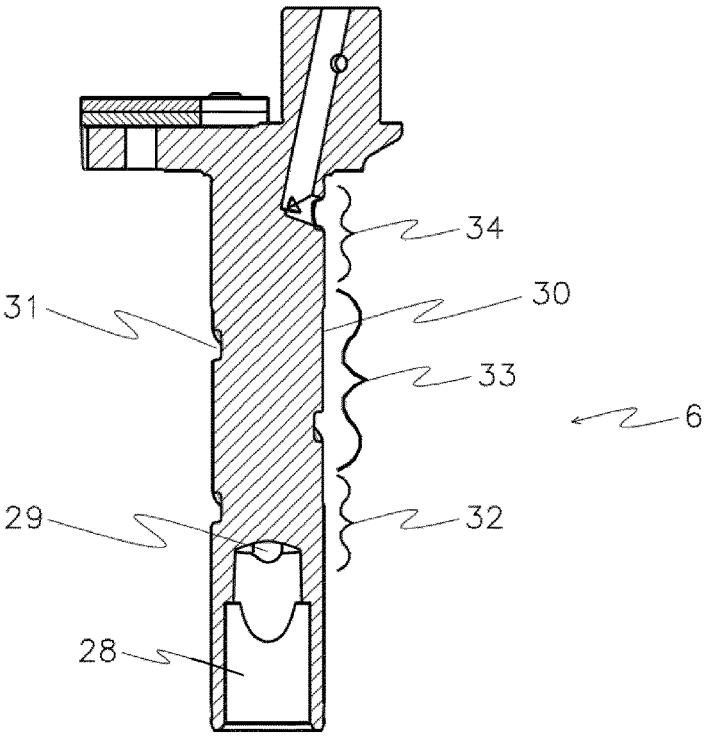
Fig. 4

Fig. 5
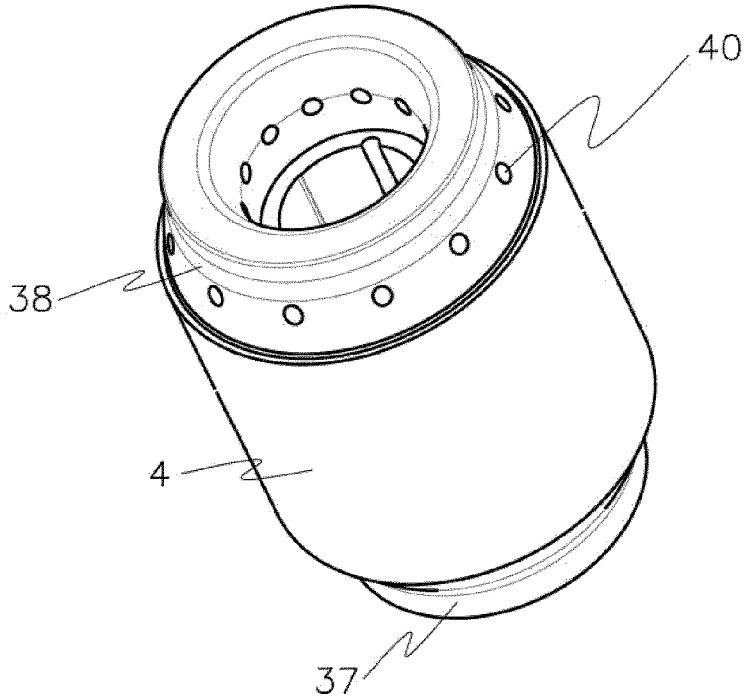
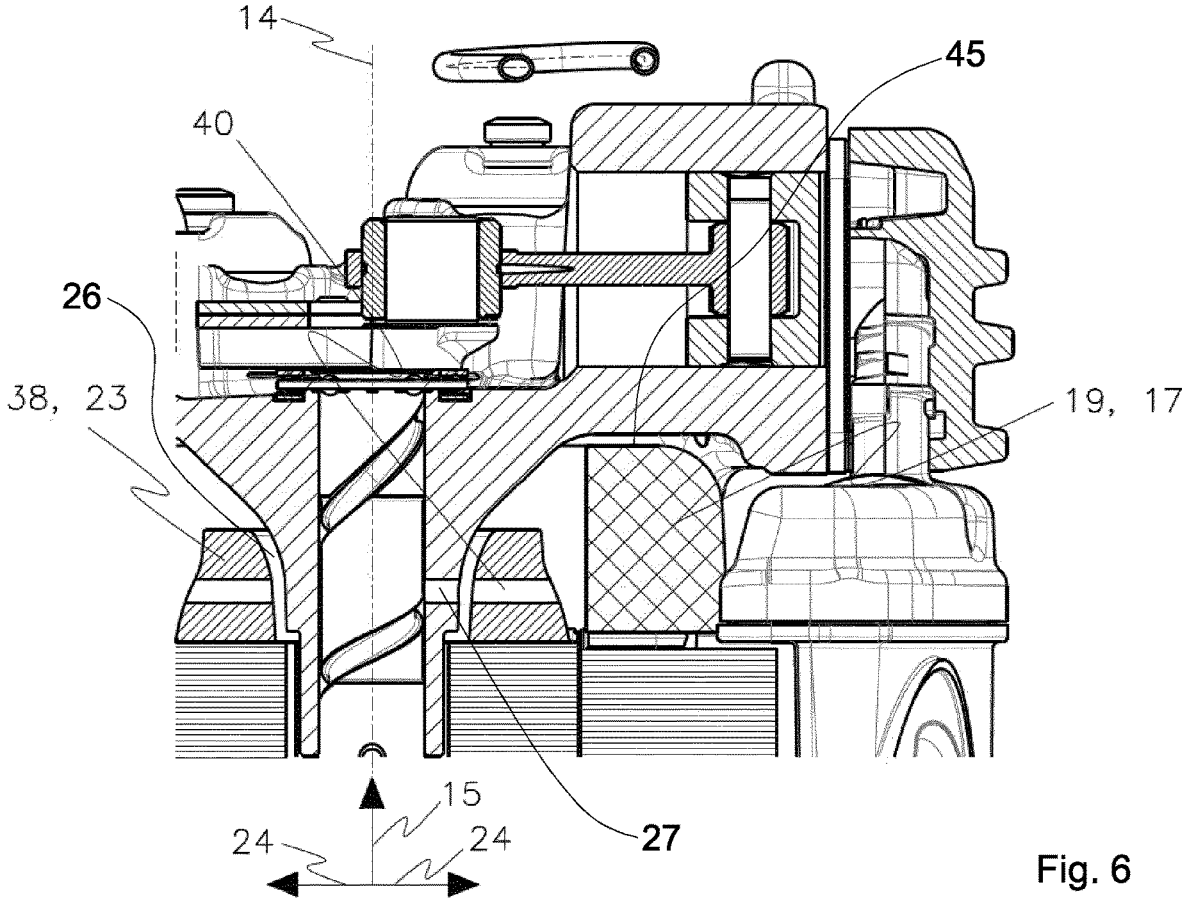
Fig. 6

Fig. 7
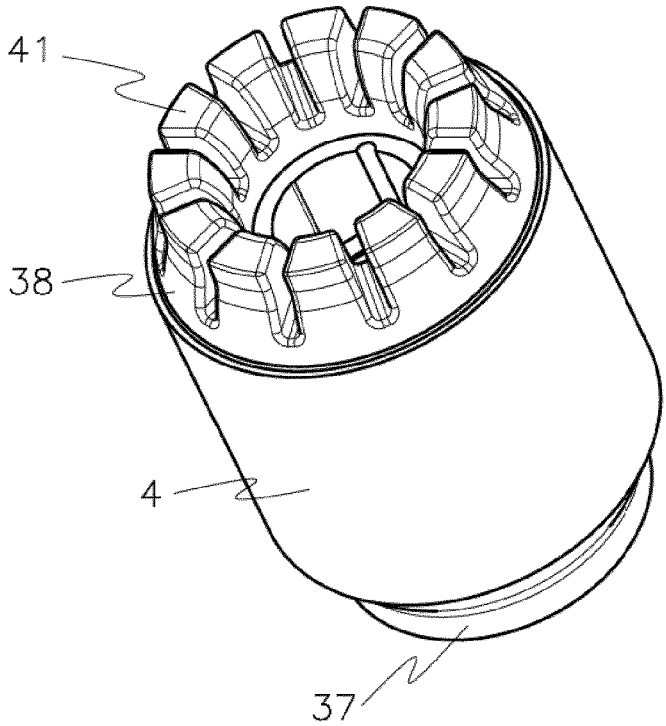
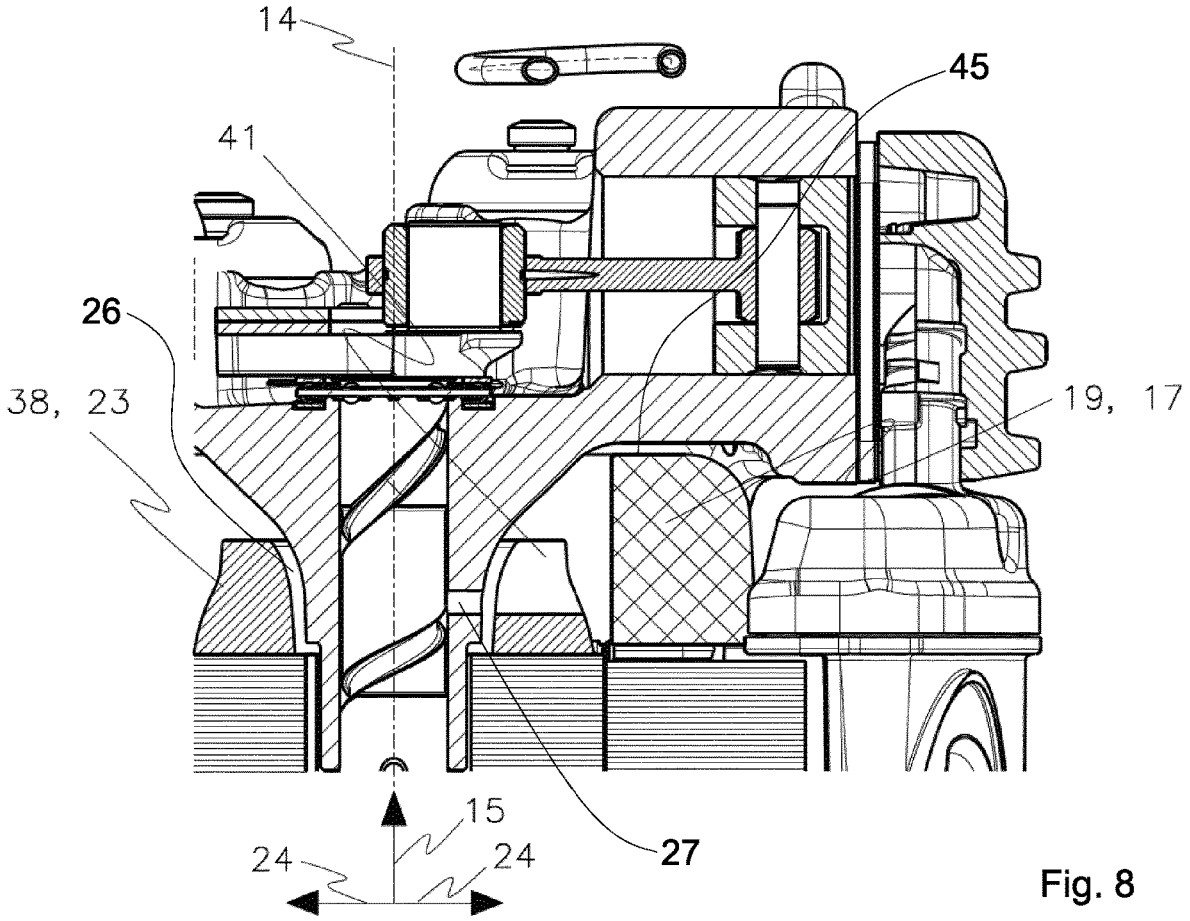
Fig. 8

Fig. 9
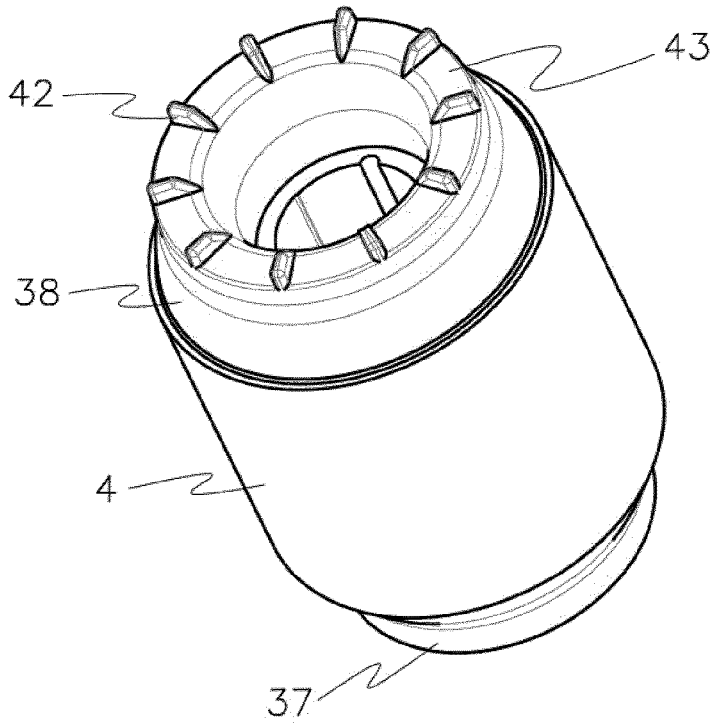
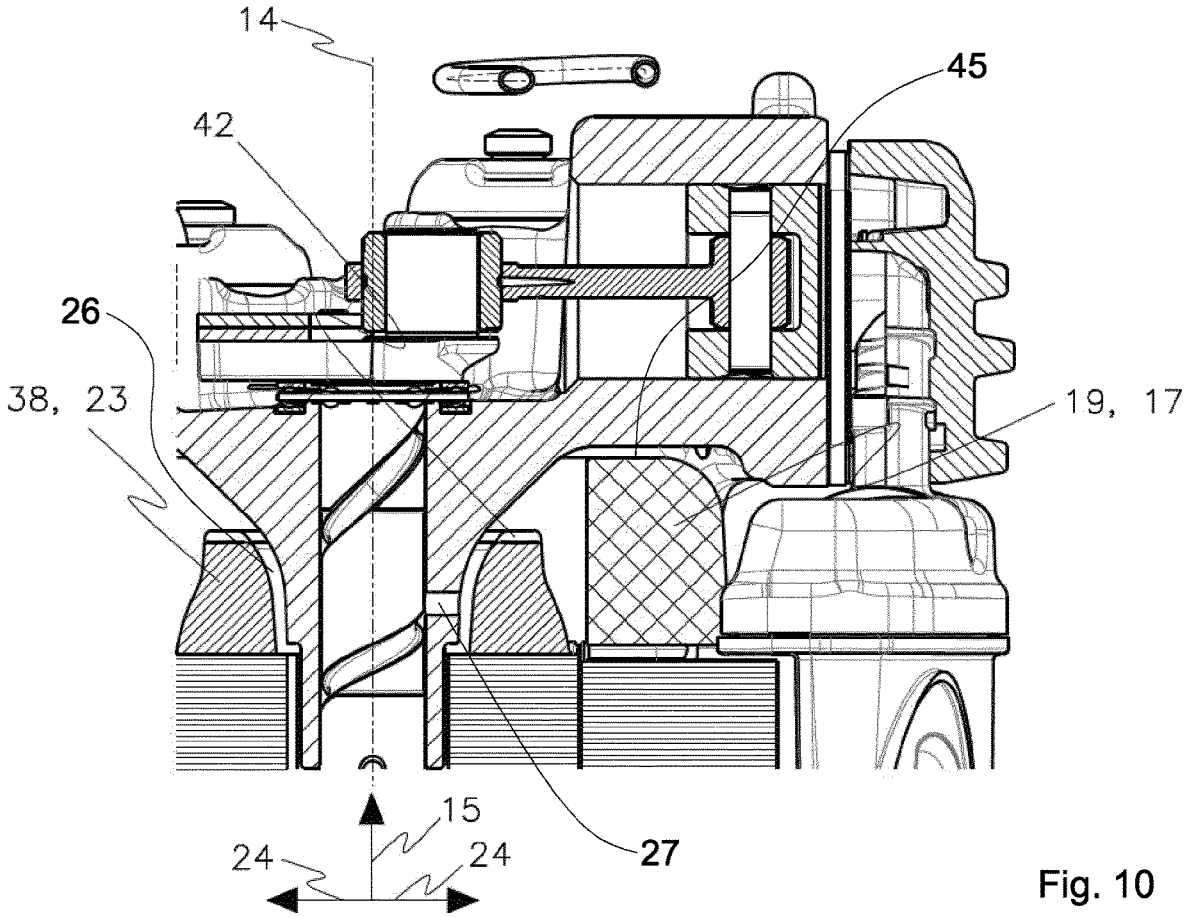
Fig. 10

Fig. 13
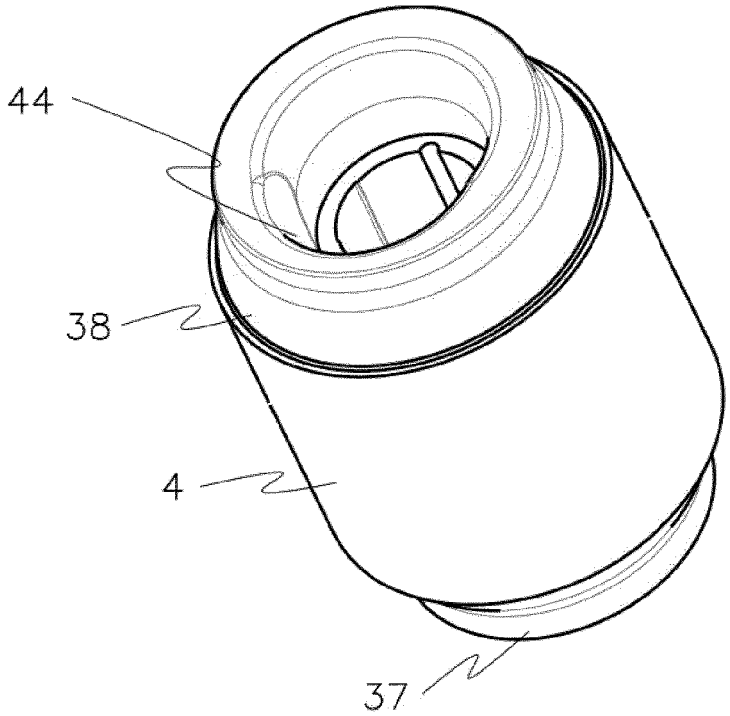
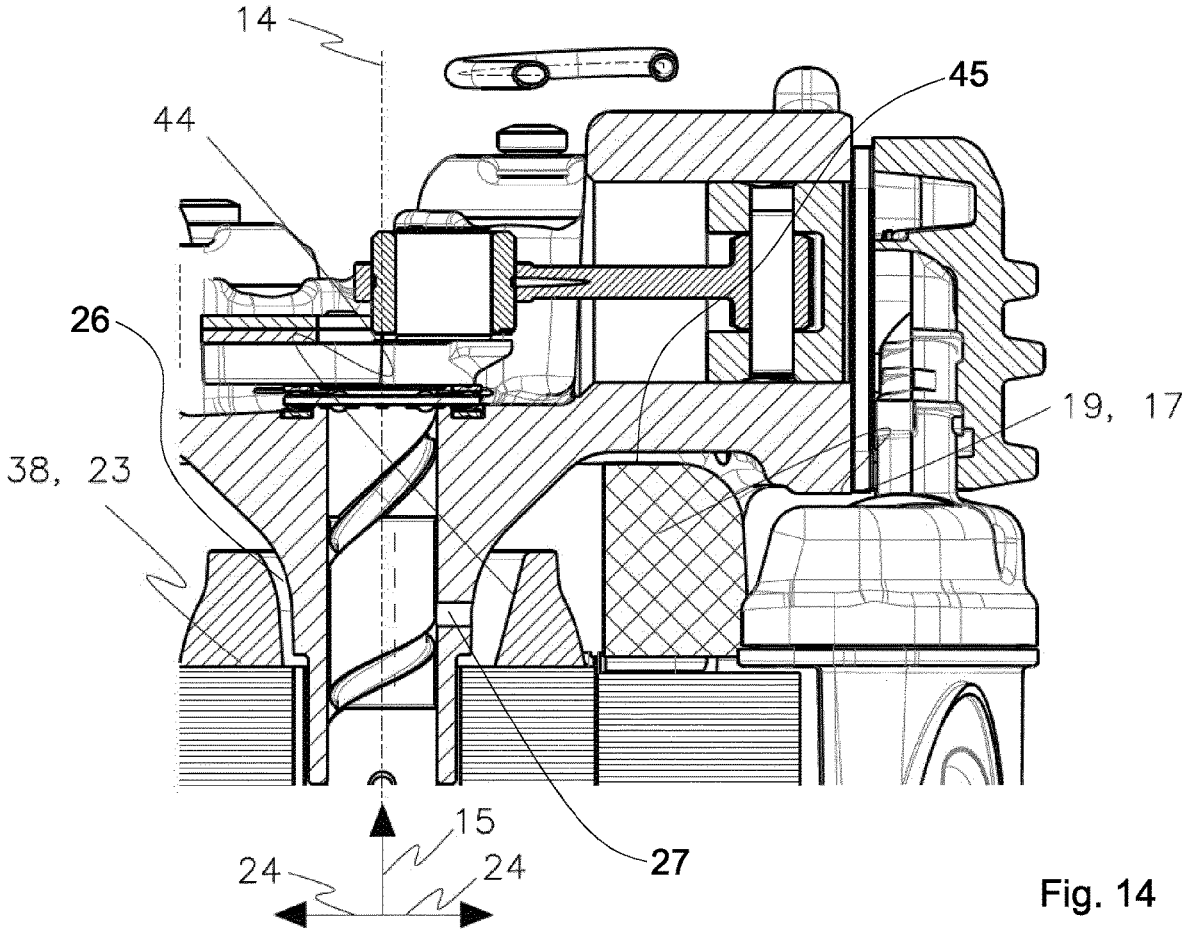
Fig. 14

REFRIGERANT COMPRESSOR

CROSS REFERENCE TO RELATED APPLICATIONS

This application is the National Stage of PCT/EP2024/057674 filed on Mar. 21, 2024, which claims priority under 35 U.S.C. § 119 of European Application No. 23163268.8 filed on Mar. 21, 2023, the disclosure of which is incorporated by reference. The international application under PCT article 21(2) was published in English.

FIELD OF THE INVENTION

The present invention relates to a refrigerant compressor with

- a hermetically encapsulated compressor housing,
- an electric drive unit arranged in a housing interior of the compressor housing and comprising a rotor rotatable about an axis of rotation, a stator, and a crankshaft, which crankshaft is connected to the rotor in a torque-proof manner,
- a piston-cylinder unit arranged in the housing interior and comprising a piston, which piston is movably arranged in a cylinder of the piston-cylinder unit and can be driven by the crankshaft to compress refrigerant,
- a lubricant receptacle for conveying lubricant from a lubricant sump arranged in a bottom area of the compressor housing vertically via the crankshaft, when the refrigerant compressor is in an operating state, wherein viewed in a first direction the stator extends from a first stator section to a second stator section and the rotor extends from a first rotor section to a second rotor section, wherein the first direction is parallel to the axis of rotation and points from the bottom area to the piston-cylinder unit, wherein the crankshaft is partially arranged in a bush-like section of a compressor block, wherein, viewed in radial directions normal to the first direction and pointing away from the axis of rotation, an interspace is formed between the second stator section and the compressor block, in which interspace the second rotor section is arranged at least partially, wherein, viewed in the radial directions, a gap is formed between the second rotor section and the compressor block.

STATE OF THE ART

Refrigerant compressors in the form of reciprocating compressors with a hermetically encapsulated compressor housing and an electric drive unit arranged in a housing interior of the compressor housing are well known. The electric drive unit, which is also referred to as electric motor in the following, comprises a rotor rotatable about an axis of rotation, a stator, and a crankshaft, which crankshaft is connected to the rotor in a torque-proof manner. A piston-cylinder unit is arranged in the housing interior and comprises a piston, which is movably arranged in a cylinder of the piston-cylinder unit and can be driven by the crankshaft to compress refrigerant and, furthermore, circulate the refrigerant through a refrigeration system.

Due to unavoidable losses the electric motor heats up while the refrigerant compressor is running. Hence, it is an objective to guarantee that the temperature of the electric motor does not exceed a critical level during operation of the compressor in the entire range of working conditions. One way to solve this problem is to dimension the electric motor sufficiently large, particularly with a relatively large height of the stator, wherein the stator usually has a stator lamination and stator windings with lower and upper coils.

In order to avoid increasing motor dimensions, lubricant, which is needed for lubricating the crankshaft, the piston and connecting parts (the so-called crank mechanism), can be used to cool the electric motor at least partially. Particularly, the lower coil of the stator can be immersed in lubricant and oil, respectively, wherein the oil simultaneously cools the lower coil of the stator.

However, the upper coil, which is covered by a compressor block, has no cooling, typically. Hence, there is the danger that the stator thus overheats in certain conditions.

In order to allow also for a cooling of the upper coil of the stator, it is known from EP 4092271 A1 to provide at least one channel in the rotor, wherein lubricant is transported by means of said at least one channel together with a screw groove on the crankshaft to the upper part of the rotor, which upper part of the rotor is formed by a rotor ring. From the rotor ring the lubricant is sprayed by centrifugal force onto the upper coil of the stator, where it absorbs heat and thus lowers the temperature of the stator. However, this solution is disadvantageous in that the required design change of the rotor is technically costly and expensive. Moreover, the streaming of the lubricant to the upper coil of the stator is limited, which in turn limits the cooling of said upper coil.

U.S. Pat. No. 3,560,116 A discloses a generic hermetically sealed encapsulated refrigeration compressor, wherein a motor is cooled by an oil flow separated from the oil flow lubricating the compressor.

U.S. Pat. No. 3,630,316 A discloses an assembly for lubricating an enclosed horizontal compressor. The lubricating device is realized by a disc, fixed on a shaft, which disc is dipped in an oil sump and drags a certain amount of oil, owing to adhesive force. The oil is distributed via a circumferential groove on the front surface of the compressor casting.

OBJECTIVE OF THE INVENTION

It is thus an objective of the present invention to provide a refrigerant compressor avoiding the above-mentioned disadvantages. Particularly, the refrigerant compressor according to the invention shall allow for compact designs and simultaneously for efficient cooling of the electric motor, particularly of the upper coil of the stator, in a structurally simple manner. Preferably, the cooling shall be improved compared to known solutions.

SUMMARY OF THE INVENTION

In order to solve the above-mentioned problems, in a refrigerant compressor with

- a hermetically encapsulated compressor housing,
- an electric drive unit arranged in a housing interior of the compressor housing and comprising a rotor rotatable about an axis of rotation, a stator, and a crankshaft, which crankshaft is connected to the rotor in a torque-proof manner,
- a piston-cylinder unit arranged in the housing interior and comprising a piston, which piston is movably arranged in a cylinder of the piston-cylinder unit and can be driven by the crankshaft to compress refrigerant,
- a lubricant receptacle for conveying lubricant from a lubricant sump arranged in a bottom area of the compressor housing vertically via the crankshaft, when the refrigerant compressor is in an operating state, wherein viewed in a first direction the stator extends from a first stator section to a second stator section and the rotor extends from a first rotor section to a second rotor section, wherein the first direction is parallel to the axis of rotation and points from the bottom area to the piston-cylinder unit, wherein the crankshaft is partially arranged in a bush-like section of a compressor block, wherein, viewed in radial directions normal to the first direction and pointing away from the axis of rotation, an interspace is formed between the second stator section and the compressor block, in which interspace the second rotor section is arranged at least partially, wherein, viewed in the radial directions, a gap is formed between the second rotor section and the compressor block, according to the invention it is provided that for the lubricant at least one through-hole is provided in the compressor block between the crankshaft and the gap.

As mentioned above the refrigerant can be circulated through a refrigeration system, e.g. of a refrigerator, by means of the refrigerant compressor in its operating state.

Lubricant receptacles as such are known. The lubricant receptacle can be arranged at the crankshaft and can be connected to or integrated into the crankshaft, such that the lubricant receptacle is rotated together with the crankshaft in the operating state of the refrigerant compressor. Typically, the lubricant receptacle has a sleeve-shaped section which protrudes with an end section into the lubricant sump, which is arranged in the housing interior. Lubricant that has penetrated through an inlet opening from the lubricant sump into the lubricant receptacle is forced into a kind of paraboloid shape at an inner wall of the lubricant receptacle due to the rotation of the lubricant receptacle—which is caused by rotation of the crankshaft—and the corresponding centrifugal force. Accordingly, the lubricant moves along the inner wall of the lubricant receptacle and along an inner wall of the crankshaft which is formed hollow or provided with an inner channel or bore in fluid communication with the lubricant receptacle. Moreover, the crankshaft can have further transportation or guiding means for the lubricant at its lateral area or surface, e.g. one or more grooves, which preferably run in a spiral or helical form viewed along a longitudinal axis of the crankshaft, with the longitudinal axis of the crankshaft typically coinciding with the axis of rotation. Said transportation/guiding means are fluidically connected with the hollow interior or bore of the crankshaft, e.g. by means of at least one connection hole, through which the lubricant can stream.

Hence, the lubricant is conveyed by means of the lubricant receptacle vertically via the crankshaft when the refrigerant compressor is in its operating state, wherein the lubricant is conveyed at least in sections within the crankshaft and/or on the lateral area or surface of the crankshaft.

The stator usually comprises first stator windings arranged in the first stator section. Typically, the first stator section is arranged below the second stator section when the refrigerant compressor is in its operating state and thus the first stator windings can be referred to as lower stator windings in this case.

Analogously, the stator can comprise second stator windings arranged in the second stator section, which is arranged above the first stator section when the refrigerant compressor is in its operating state, typically. Thus, the second stator windings can be referred to as upper stator windings in this case.

Typically, the stator comprises also a stator lamination extending between the first and second stator sections.

The rotor can comprise a first rotor ring in the first rotor section, wherein the first rotor section can also consist of the first rotor ring. Moreover, the rotor can comprise a second rotor ring in the second rotor section, wherein the second rotor section can also consist of the second rotor ring. Typically, the first rotor section is arranged below the second rotor section when the refrigerant compressor is in its operating state and thus the first rotor ring can be referred to as lower rotor ring and the second rotor ring can be referred to as upper rotor ring in this case.

Typically, the rotor comprises also a rotor lamination extending between the first and second rotor sections.

The crankshaft is arranged in sections in the bush-like section of the compressor block, with the compressor block preferably also providing a bearing for the crankshaft.

Mathematically, there is an infinite number of radial directions. Accordingly, "the radial directions" and "the radial direction" both denote all those possible directions if not something different is stated explicitly.

The second rotor section, particularly the second rotor ring, can be arranged in the interspace in sections or as a whole.

Preferably, the gap between the second rotor section and the compressor block runs with a directional component parallel to the first direction and is open toward the interspace.

In the operating state of the refrigerant compressor, lubricant is conveyed into the gap and is further transported or distributed via the interspace to the second stator section for effecting cooling of the second stator section, particularly of the second stator windings in the second stator section.

In order to avoid a technically costly and expensive rotor design with channels in the rotor for transporting the lubricant into the gap, the at least one through-hole in the compressor block is provided. In the operating state of the refrigerant compressor the at least one through-hole allows for a flow of lubricant from the side of the crankshaft within the bush-like section of the compressor block-into the gap, from where the lubricant can be distributed to the second stator section for cooling said second stator section. The one or more through-holes can be easily manufactured as drilled holes, without the need for altering the rotor design.

In a preferred embodiment of the refrigerant compressor according to the present invention, it is provided that an accumulation volume for accumulating lubricant is provided between a lateral surface of the crankshaft and an inner wall of the bush-like section of the compressor block, wherein the accumulation volume is fluidically connected with the at least one through-hole. The accumulation volume provides for a lubricant reservoir in the operating state of the refrigerant compressor, improving the stream of lubricant or oil via the at least one through-hole into the gap and hence further to the second stator section.

While it is conceivable that the at least one through-hole is fluidically connected with the accumulation volume by connection means like a connection channel, it is provided in a particularly preferable embodiment of the refrigerant compressor according to the present invention that, viewed along the axis of rotation, the accumulation volume is arranged in the region of the at least one through-hole and the at least one through-hole fluidically connects the accumulation volume with the gap. The latter means a direct fluidic connection between the at least one through-hole and the accumulation volume, without any connection means in-between. This guarantees a particularly efficient transport of lubricant into the gap and hence further to the second stator section. More generally, in a particularly preferred embodiment of the refrigerant compressor according to the invention it is provided that the at least one through-hole fluidically connects the accumulation volume and the gap.

As explained above, the lubricant can be transported or guided via the crankshaft by means of a channel or hollow interior of the crankshaft working together (via at least one connection hole) with at least one groove arranged at the lateral surface of the crankshaft. Hence, in case of an embodiment comprising the accumulation volume, the lubricant can be conveyed from the lubricant receptacle into the accumulation volume. Accordingly and more generally speaking, in a particularly preferred embodiment of the refrigerant compressor according to the present invention, it is provided that the crankshaft comprises transportation means for transporting the lubricant from the lubricant receptacle to the accumulation volume when the refrigerant compressor is in the operating state. Said transportation or guiding means can be built in one piece with the crankshaft or as separate elements.

In order to provide a design for allowing a particularly easy manufacturing, in a particularly preferred embodiment of the refrigerant compressor according to the present invention, it is provided that the crankshaft comprises an inner channel for vertically conveying the lubricant within the crankshaft in the operating state of the refrigerant compressor, a connection hole fluidically connecting the inner channel with the lateral surface of the crankshaft, a helical groove arranged on the lateral surface for further vertically conveying the lubricant, wherein, viewed in the first direction, the helical groove extends on the lateral surface of the crankshaft from a first surface section via an intermediate surface section to a second surface section, with the first, intermediate and second surface sections being arranged in the bush-like section of the compressor block, wherein the accumulation volume for accumulating lubricant is provided only between the intermediate surface section or the intermediate surface section and the second surface section on the one hand and the inner wall of the bush-like section of the compressor block on the other hand.

Naturally, it is conceivable to provide several inner channels and/or several connections holes and/or several helical grooves, e.g. for fine-tuning the amount of lubricant delivered.

The inner channel can be manufactured as drilled hole.

The inner channel can run parallel to the longitudinal axis of the crankshaft or the axis of rotation, respectively, or can be inclined to said axis.

The helical groove provides for an improved transportation of the lubricant via the lateral surface of the crankshaft, obviously in the operating state of the refrigerant compressor.

In the first direction, the accumulation volume can be bounded by the first surface section on the one hand, and by the second surface section or by a section of the crankshaft that follows the second surface section on the other hand. For example, said section of the crankshaft that follows the second surface section can be formed by the crank pin.

In order to enable a particularly easy manufacturing of the accumulation volume, in a particularly preferred embodiment of the refrigerant compressor according to the present invention, it is provided that within the extension of the accumulation volume a maximum diameter of the crankshaft is smaller and/or a minimum inner diameter of the bush-like section of the compressor block is greater than in at least one adjacent region. The inner diameter of the bush-like section is measured in the (clear) cross-section of the bush-like section of the compressor block, wherein said cross-section is bounded by the inner wall of the bush-like section of the compressor block.

Hence, the accumulation volume can be easily formed as clear cross-section between a section of the crankshaft arranged in the bush-like section of the compressor block and the inner wall of the bush-like section of the compressor block. Accordingly, in the radial directions the accumulation volume is bounded by the crankshaft and its lateral surface, respectively, and the inner wall of the bush-like section of the compressor block.

In a particularly preferred embodiment of the refrigerant compressor according to the present invention, it is provided that a maximum diameter of the crankshaft in the region of the intermediate surface section is smaller than in the region of the first surface section and preferably the maximum diameter of the crankshaft in the region of the intermediate surface section is smaller than in the region of the second surface section. In this way, the accumulation volume can be defined particularly precisely.

In a preferred embodiment of the refrigerant compressor according to the present invention, it is provided that the rotor comprises a rotor ring arranged in the second rotor section, which rotor ring has an inner surface facing toward the crankshaft, wherein the rotor ring is preferably made of aluminium or of an aluminium alloy.

Typically, the main function of the rotor ring is to hold, and preferably keep together, a lamination of the rotor, wherein another rotor ring can be provided in the first rotor section for that purpose too. The rotor lamination can be formed by lamellas of electrical steel.

The inner surface of the rotor ring is limiting the gap, particularly in the radial directions.

In order to foster a directed distribution of the lubricant from the gap toward the second stator section by virtue of centrifugal force when the refrigerant compressor is in its operating state, in a particularly preferred embodiment of the refrigerant compressor according to the present invention, it is provided that a distance measured between the axis of rotation and the inner surface of the rotor ring along the radial directions increases, preferably continuously, along the first direction. This means that viewed in the first direction the gap widens toward the interspace. This in turn has the effect that, when the refrigerant compressor is in its operating state, lubricant is centrifuged out of the gap with a rather large—instead of a rather small or negligible—directional component parallel to the radial directions. Thus, the lubricant can be centrifuged out of the gap better toward the second stator section, where the lubricant can provide for cooling.

In order to further optimise the delivery of lubricant to the second stator section by means of centrifugal forces acting when the rotor, particularly the rotor ring, rotates in the operating state of the refrigerant compressor, in a particularly preferred embodiment of the refrigerant compressor according to the present invention, it is provided that the inner surface of the rotor ring has a bevelled and/or curved shape. Said shape can promote a continuous streaming of the lubricant out of the gap toward the second stator section, in the operating state of the refrigerant compressor.

Usually, the inner surface of the rotor ring and, more generally, the whole rotor ring are more or less perfectly rotationally symmetric with respect to the axis of rotation. Typically, this rotational symmetry helps avoiding any unbalanced mass that could negatively influence the turning behaviour of the rotor and thus the performance of the electric motor and the refrigerant compressor, respectively.

Moreover, said unbalanced mass could have an impact on the robustness of the compressor, since a higher vibration level caused by an unbalanced rotor can lead to a suspension springs failure.

However, it was surprisingly found that lubricant distribution means that break said rotational symmetry can significantly improve the streaming and delivery of lubricant toward the second stator section. Unbalanced masses that could negatively influence the performance and/or robustness of the refrigerant compressor can still be avoided rather easily, e.g. by arranging the lubricant distribution means around the axis of rotation such that an n-fold symmetry is realised, with n being an integer greater than 1 and/or by providing at least one balance weight.

Thus, in a particularly preferred embodiment of the refrigerant compressor according to the present invention, it is provided that lubricant distribution means are provided, which lubricant distribution means are formed by openings in the rotor ring that fluidically connect the gap with the interspace, wherein said openings run with a directional component parallel to the radial direction. Those sections of the rotor ring that are formed by said openings do not limit the gap and help creating streams of the lubricant into the interspace and toward the second stator section.

Advantageously, said openings can be easily manufactured, e.g. by drilling or milling, particularly keywaying. Accordingly, in a particularly preferred embodiment of the refrigerant compressor according to the present invention, it is provided that the openings comprise distribution through-holes that are bounded by the rotor ring in the first direction and/or distribution notches that, viewed in the first direction, have an open end. For example, the distribution through-holes can be drilled and/or the distribution notches can be milled. The distribution through-holes allow for a quite precise definition of the direction, into which the lubricant is to be delivered. The distribution notches allow for the delivery of a particularly large amount of lubricant from the gap into the interspace toward the second stator section in a certain amount of time, when the refrigerant compressor is in its operating state.

Additionally or alternatively, in a particularly preferred embodiment of the refrigerant compressor according to the present invention, it is provided that lubricant distribution means are provided, which lubricant distribution means are formed by spray blades arranged on a top surface of the rotor ring, which top surface faces into the first direction. Said spray blades allow for a particularly precise adjustment of the direction into which the lubricant is sprayed when it is centrifuged out of the gap. Hence, it can be ensured that a particularly large ratio of lubricant, which is centrifuged out of the gap, directly reaches the second stator section, improving cooling efficiency.

Additionally or alternatively, in a particularly preferred embodiment of the refrigerant compressor according to the present invention, it is provided that the inner surface of the rotor ring forms at least one pocket, breaking the rotational symmetry of the inner surface with respect to the axis of rotation. The at least one pocket increases the volume in the gap for the lubricant. Hence, in the operating state of the refrigerant compressor more lubricant can be conveyed into the gap, which fosters the creation of lubricant streams and thus improves streaming and delivery of the lubricant out of the gap toward the second stator section. In turn, cooling of the second stator section by the lubricant is improved.

According to the above, in a preferred embodiment of the refrigerant compressor according to the present invention, it is provided that the stator comprises second stator windings arranged in the second stator section and preferably first stator windings arranged in the first stator section.

BRIEF DESCRIPTION OF FIGURES

The invention will be explained in closer detail by reference to preferred embodiments, with FIG. 1 showing a sectional view of a first embodiment of a refrigerant compressor according to the present invention FIG. 2 showing an enlarged view of detail II of FIG. 1

FIG. 3 showing a perspective view of a crankshaft of the refrigerant compressor of FIG. 1

FIG. 4 a sectional view of the crankshaft of FIG. 3

FIG. 5 showing a perspective view of a rotor of a second embodiment of the refrigerant compressor according to the present invention FIG. 6 showing a detail of a sectional view of the second embodiment of the refrigerant compressor according to the present invention FIG. 7 showing a perspective view of a rotor of a third embodiment of the refrigerant compressor according to the present invention FIG. 8 showing a detail of a sectional view of the third embodiment of the refrigerant compressor according to the present invention FIG. 9 showing a perspective view of a rotor of a fourth embodiment of the refrigerant compressor according to the present invention FIG. 10 showing a detail of a sectional view of the fourth embodiment of the refrigerant compressor according to the present invention FIG. 11 showing a perspective view of a rotor of a fifth embodiment of the refrigerant compressor according to the present invention FIG. 12 showing a detail of a sectional view of the fifth embodiment of the refrigerant compressor according to the present invention FIG. 13 showing a perspective view of a rotor of a sixth embodiment of the refrigerant compressor according to the present invention FIG. 14 showing a detail of a sectional view of the sixth embodiment of the refrigerant compressor according to the present invention

WAYS FOR CARRYING OUT THE INVENTION

Figure 1:
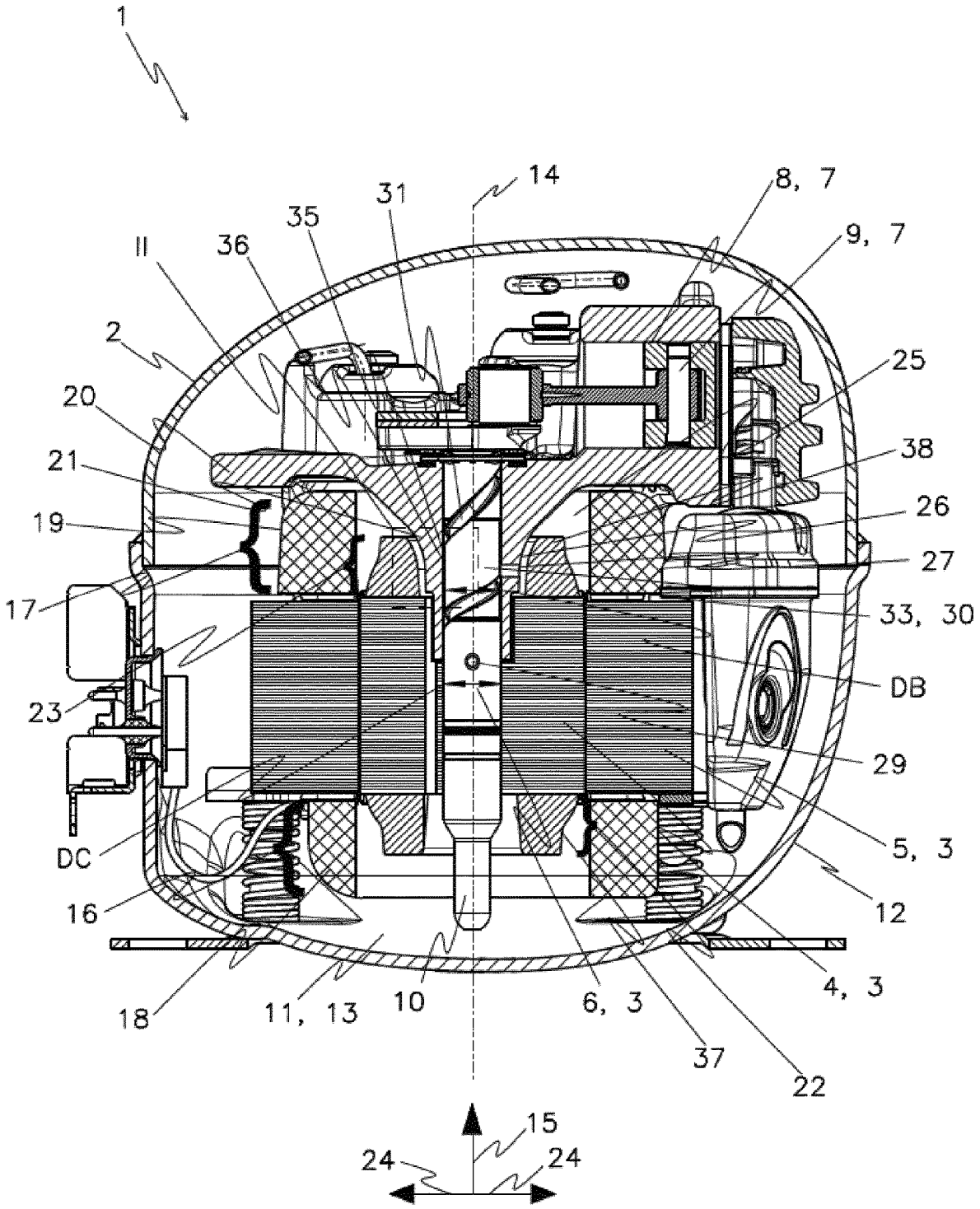

FIG. 1 shows a sectional view of a first embodiment of a refrigerant compressor 1 according to the present invention. The refrigerant compressor 1 has a hermetically encapsulated compressor housing 2, which is sometimes also referred to as shell and consists of an upper and lower part that are hermetically tight connected. An electric drive unit 3, which can also be referred to as electric motor, is arranged in a housing interior of the compressor housing 2 and comprises a rotor 4 rotatable about an axis of rotation 14, a stator 5, and a crankshaft 6, wherein the crankshaft 6 is connected to the rotor 4 in a torque-proof manner.

Furthermore, a piston-cylinder unit 7 is arranged in the housing interior of the compressor housing 2 and comprises a piston 9, wherein the piston 9 is movably arranged in a cylinder 8 of the piston-cylinder unit 7 and can be driven by the crankshaft 6 to compress refrigerant.

Furthermore, the refrigerant compressor 1 comprises a lubricant receptacle 10 for sucking and conveying lubricant 11 or oil from a lubricant sump 13 arranged in a bottom area 12 of the compressor housing 2 vertically via the crankshaft 6, when the refrigerant compressor 1 is in an operating state.

The lubricant level in the lubricant sump 13 is indicated by the solid horizontal line in FIG. 1. The lubricant receptacle 10 is connected to the crankshaft 6 in a torque-proof manner and protrudes into the lubricant sump 13, such that lubricant 11 can enter the lubricant receptacle 10.

The lubricant receptacle 10 works in a known manner making use of centrifugal forces acting on the lubricant 11 when the lubricant receptacle 10 is rotated together with the crankshaft 6 in the operating state of the refrigerant compressor 1. Lubricant 11 that has penetrated through an inlet opening (not shown) from the lubricant sump 13 into the lubricant receptacle 10 is forced into a kind of paraboloid shape at an inner wall (not shown) of the lubricant receptacle 10 due to the rotation of the lubricant receptacle 10 and the corresponding centrifugal force. Accordingly, the lubricant 11 moves along the inner wall of the lubricant receptacle 10 and along an inner wall of the crankshaft 6 which is provided with an inner channel 28, cf. FIG. 4, in fluid communication with the lubricant receptacle 10. Moreover, the crankshaft 6 has further transportation or guiding means for the lubricant 11 at its lateral surface 30 in the form of a helical groove 31 which runs in a helical form viewed along a longitudinal axis of the crankshaft 6, with the longitudinal axis of the crankshaft 6 coinciding with the axis of rotation 14. The helical groove 31 is fluidically connected with the inner channel 28 by means of a connection hole 29, through which the lubricant 11 can stream.

Viewed in a first direction 15 the stator 5 extends from a first stator section 16 to a second stator section 17 and the rotor 4 extends from a first rotor section 22 to a second rotor section 23, wherein the first direction 15 is parallel to the axis of rotation 14 and points from the bottom area 12 to the piston-cylinder unit 7. Typically, the first direction 15 is essentially antiparallel to the direction of gravity when the refrigerant compressor 1 is in its operating state.

In the shown embodiments of the refrigerant compressor 1, the stator 5 comprises second stator windings 19 arranged in the second stator section 17 and first stator windings 18 arranged in the first stator section 16. The first stator windings 18 are partially immersed in the lubricant 11 of the lubricant sump 13 and thus cooled by the lubricant 11.

The crankshaft 6 is partially arranged in a bush-like section 21 of a compressor block 20.

Viewed in radial directions 24 normal to the first direction 15 and pointing away from the axis of rotation 14, an interspace 25 is formed between the second stator section 17 and the compressor block 20, in which interspace 25 the second rotor section 23 is arranged. Viewed in the radial directions 24, a gap 26 is formed between the second rotor section 23 and the compressor block 20. In the operating state of the refrigerant compressor 1 lubricant 11 is conveyed into the gap 26 and from the gap 26 into the interspace 25 toward the second stator section 17 and the second stator windings 19. Hence, the second stator section 17 and the second stator windings 19 can be cooled by the lubricant 11.

For the lubricant 11 a through-hole 27 is provided in the compressor block 20 between the crankshaft 6 and the gap 26. In the operating state of the refrigerant compressor 1 the through-hole 27 allows for a flow of lubricant 11 from the side of the crankshaft 6—within the bush-like section 21 of the compressor block 20—into the gap 26, from where the lubricant 11 can be distributed to the second stator section 17 for cooling said second stator section 17 and the second stator windings 19, respectively. The through-hole 27 is manufactured as drilled hole, easily and in a cost-saving way.

Figure 2:
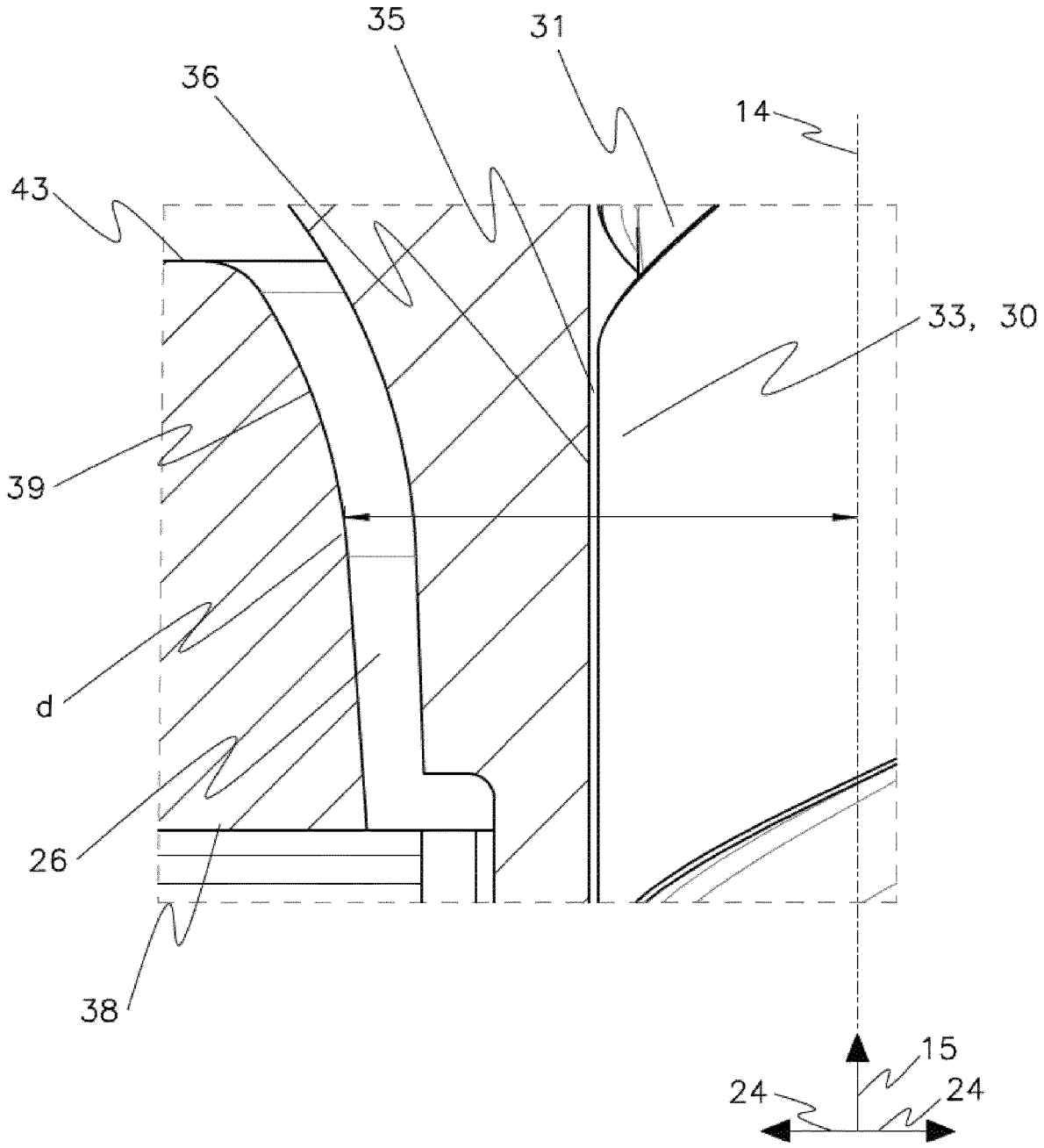

As can be seen particularly well in the enlarged view of detail II in FIG. 2, an accumulation volume 35 for accumulating lubricant 11 is provided between the lateral surface 30 of the crankshaft 6 and an inner wall 36 of the bush-like section 21 of the compressor block 20, wherein the accumulation volume 35 is fluidically connected with the through-hole 27. The accumulation volume 35 provides for a lubricant reservoir in the operating state of the refrigerant compressor 1, improving the stream of lubricant 11 via the through-hole 27 into the gap 26 and hence further to the second stator section 17.

In the shown embodiments of the refrigerant compressor 1 there is a direct fluidic connection between the through-hole 27 and the accumulation volume 35 and, hence, the through-hole 27 fluidically connects the accumulation volume 35 and the gap 26.

As mentioned above, the crankshaft 6 comprises the inner channel 28, the connection hole 29 and the helical groove 31. Those elements constitute transportation means for transporting the lubricant 11 from the lubricant receptacle 10 to the accumulation volume 35 when the refrigerant compressor 1 is in the operating state.

Viewed in the first direction 15, the helical groove 31 extends on the lateral surface 30 of the crankshaft 6 from a first surface section 32 via an intermediate surface section 33 to a second surface section 34, cf. FIG. 3. The first surface section 32, the intermediate surface section 33 and the second surface section 34 are arranged in the bush-like section 21 of the compressor block 20. In the shown embodiments of the refrigerant compressor 1, the accumulation volume 35 is provided only between the intermediate surface section 33 and the inner wall 36 of the bush-like section 21 of the compressor block 20.

For an easy manufacturing of the accumulation volume 35, within the extension of the accumulation volume 35 a maximum diameter DC of the crankshaft 6 is smaller than in the adjacent regions. Hence, the maximum diameter DC of the crankshaft 6 in the region of the intermediate surface section 33 is smaller than in the region of the first surface section 32 and is smaller than in the region of the second surface section 34. For the sake of completeness it is noted that, additionally or alternatively, within the extension of the accumulation volume 35 a minimum inner diameter DB of the bush-like section 21 of the compressor block 20 can be greater than in at least one adjacent region.

In the shown embodiments of the refrigerant compressor 1, the rotor 4 has a first rotor ring 37 constituting the first rotor section 22 and a second rotor ring 38 constituting the second rotor section 23. The main function of the rotor rings 37, 38 is to hold, and preferably keep together, a lamination of the rotor 4. The rotor lamination is formed by lamellas of electrical steel, whereas the rotor rings 37, 38 are made of aluminium or an aluminium alloy.

The second rotor ring 38 has an inner surface 39 facing toward the crankshaft 6 and limiting the gap 26, particularly in the radial directions 24.

As can be seen particularly well in FIG. 2, a distance d measured between the axis of rotation 14 and the inner surface 39 of the second rotor ring 38 along the radial directions 24 increases essentially continuously along the first direction 15.

Specifically, the inner surface 39 has a bevelled and then curved shape seen along the first direction 15.

This means that viewed in the first direction 15 the gap 26 widens toward the interspace 25. This in turn has the effect that, when the refrigerant compressor 1 is in its operating state, lubricant 11 is centrifuged out of the gap 26 with a rather large-instead of a rather small or negligible directional component parallel to the radial directions 24. Thus, the lubricant 11 can be centrifuged out of the gap 26 better toward the second stator section 17, where the lubricant 11 can provide for cooling of the second stator windings 19.

It was surprisingly found that lubricant distribution means that break the rotational symmetry of the second rotor ring 38, particularly of its inner surface 39, with respect to the axis of rotation 14 can significantly improve the streaming and delivery of lubricant 11 toward the second stator section 17.

Such lubricant distribution means can be formed by openings in the second rotor ring 38 and its inner surface 39, respectively, that fluidically connect the gap 26 with the interspace 25, wherein said openings run with a directional component parallel to the radial direction 24.

As an example, FIG. 5 shows a rotor 4 of a second embodiment of the refrigerant compressor 1, wherein said openings are formed as distribution through-holes 40 that are bounded by the second rotor ring 38 in the first direction 15. The distribution through-holes 40 can be easily manufactured by drilling and allow for a quite precise definition of the direction, into which the lubricant 11 is to be delivered. In the shown second embodiment, the distribution through holes 40 run along the radial directions 24, see FIG. 6. Viewed along the axis of rotation 14, the distribution through-holes 40 are arranged essentially at the same position as the through-hole 27, improving the streaming and through-put of lubricant 11 from the gap 26 toward the second stator section 17 and the second stator windings 19, respectively.

As a further example, FIG. 7 shows a rotor 4 of a third embodiment of the refrigerant compressor 1, wherein the mentioned openings are formed as distribution notches 41 that, viewed in the first direction 15, have an open end. The distribution notches 41 can be easily manufactured by milling and allow for the delivery of a particularly large amount of lubricant 11 from the gap 26 into the interspace 25 toward the second stator section 17 and the second stator windings 19, respectively, in a certain amount of time, when the refrigerant compressor 1 is in its operating state. In the shown third embodiment, the extension of the distribution notches 41 along the axis of rotation 14 begins essentially at the same position as the extension of the through-hole 27, cf. FIG. 8, further improving the streaming and through-put of lubricant 11 from the gap 26 toward the second stator section 17 and the second stator windings 19, respectively.

FIG. 9 shows a perspective view of a rotor 4 of a fourth embodiment of the refrigerant compressor 1, wherein the rotational symmetry-breaking lubricant distribution means are formed by spray blades 42 arranged on a top surface 43 (cf. also FIG. 2) of the second rotor ring 38, which top surface 43 faces into the first direction 15. Said spray blades 42 allow for a particularly precise adjustment of the direction into which the lubricant 11 is sprayed when it is centrifuged out of the gap 26. Hence, it can be ensured that a particularly large ratio of lubricant 11, which is centrifuged out of the gap 26, directly reaches the second stator section 17, improving cooling efficiency, when the refrigerant compressor 1 is in its operating state. Moreover, as can be seen in FIG. 10, the spray blades 42 are arranged closest to an end 45 of the second stator section 17 viewed along the first direction 15. Accordingly, the spray blades 42 can provide for a particularly well distribution of lubricant 11 into the region of said end 45, allowing for a particularly efficient cooling of the second stator windings 19 in this region.

Figure 11:
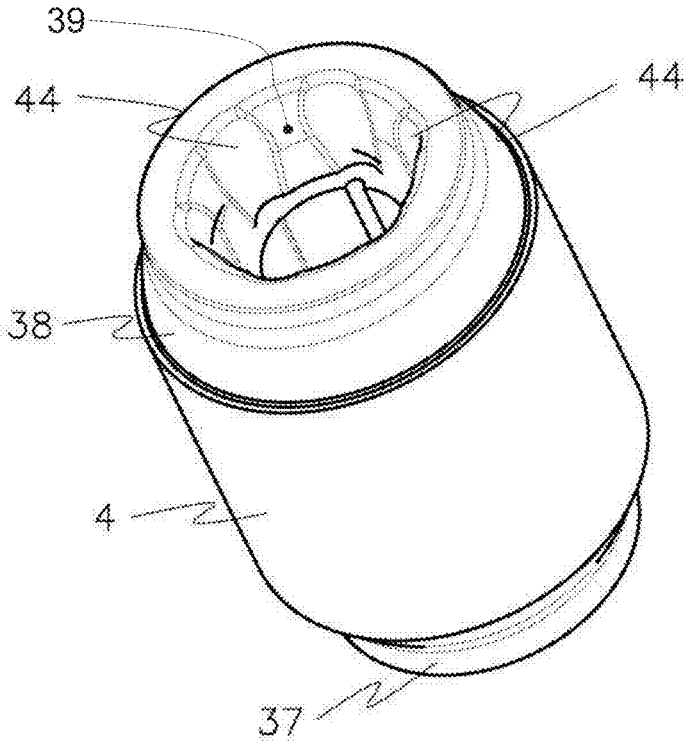

FIG. 11 shows a perspective view of a rotor 4 of a fifth embodiment of the refrigerant compressor 1, wherein for providing the rotational symmetry-breaking lubricant distribution means the inner surface 39 of the second rotor ring 38 forms several pockets 44, breaking the rotational symmetry of the inner surface 39 (and thus of the second rotor ring 38) with respect to the axis of rotation 14.

Figure 12:
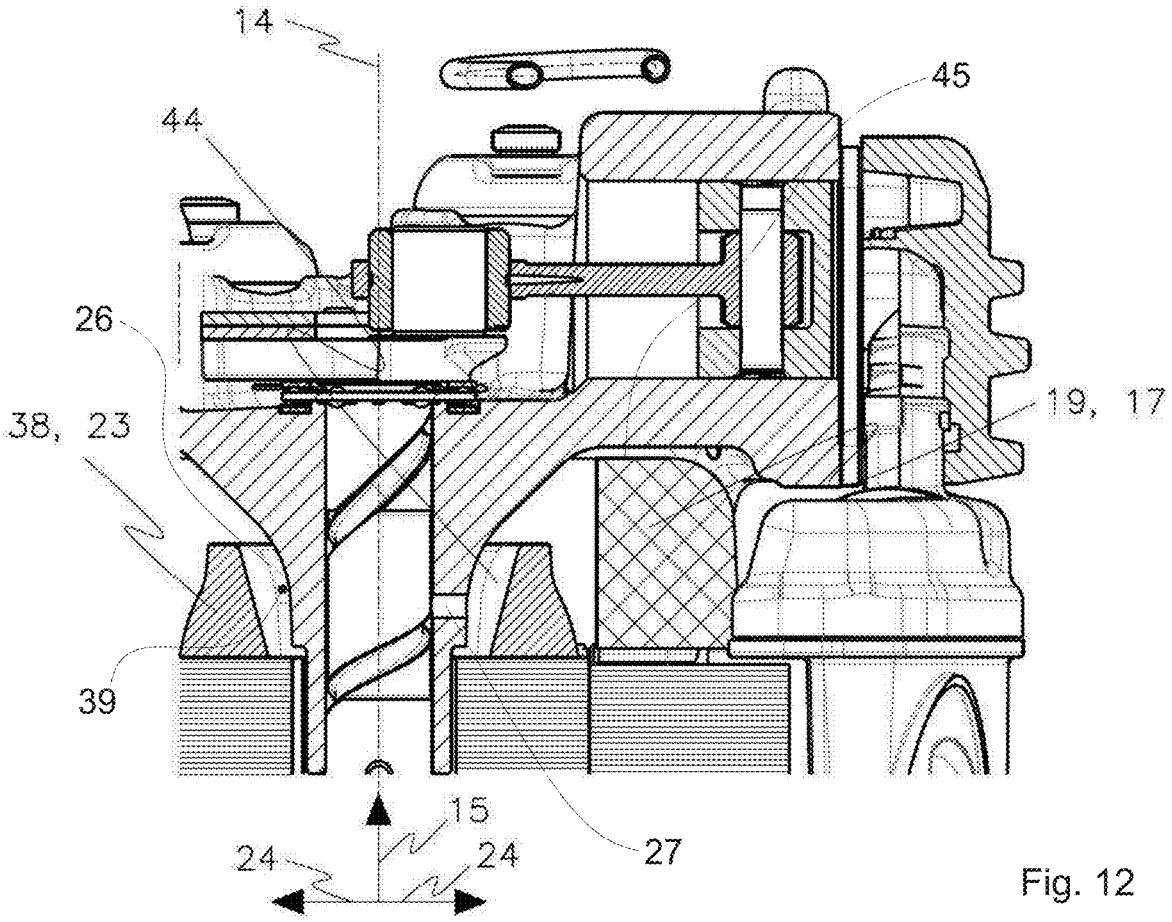

The pockets 44 increase the volume in the gap 26 for the lubricant 11, cf. FIG. 12. Hence, in the operating state of the refrigerant compressor 1 more lubricant 11 can be conveyed into the gap 26, which fosters the creation of lubricant streams and thus improves streaming and delivery of the lubricant 11 out of the gap 26 toward the second stator section 17. In turn, cooling of the second stator section 17 and the second stator windings 19, respectively, by the lubricant 11 is improved.

In principle, a significant increase of volume for the lubricant 11 in the gap 26 can already be accomplished by means of only one pocket 44. This is illustrated as sixth embodiment, wherein FIG. 13 shows the rotor 4 with one pocket 44 and FIG. 14 shows a detail of a corresponding sectional view.

LIST OF REFERENCE SIGNS

1 Refrigerant compressor
2 Compressor housing
3 Electric drive unit
4 Rotor
5 Stator
6 Crankshaft
7 Piston-cylinder unit
8 Cylinder
9 Piston
10 Lubricant receptacle
11 Lubricant
12 Bottom area of the compressor housing
13 Lubricant sump
14 Axis of rotation
15 First direction
16 First stator section
17 Second stator section
18 First stator windings
19 Second stator windings
20 Compressor block
21 Bush-like section of the compressor block
22 First rotor section
23 Second rotor section
24 Radial direction
25 Interspace
26 Gap
27 Through-hole
28 Inner channel
29 Connection hole
30 Lateral surface of the crankshaft
31 Helical groove
32 First surface section
33 Intermediate surface section
34 Second surface section
35 Accumulation volume
36 Inner wall
37 First rotor ring
38 Second rotor ring
39 Inner surface of the second rotor ring
40 Distribution through-hole
41 Distribution notch
42 Spray blade

43 Top surface of the second rotor ring
45 End of the second stator section viewed along the first direction
DC Crankshaft diameter
DB Inner diameter of the bush-like section of the compressor block
d Distance between the axis of rotation and the inner surface of the second rotor ring

The invention claimed is:

1. A refrigerant compressor (1) with a hermetically encapsulated compressor housing (2), an electric drive unit (3) arranged in a housing interior of the compressor housing (2) and comprising a rotor (4) rotatable about an axis of rotation (14), a stator (5), and a crankshaft (6), which crankshaft (6) is connected to the rotor (4) in a torque-proof manner, a piston-cylinder unit (7) arranged in the housing interior and comprising a piston (9), which piston (9) is movably arranged in a cylinder (8) of the piston-cylinder unit (7) and can be driven by the crankshaft (6) to compress refrigerant, a lubricant receptacle (10) for conveying lubricant (11) from a lubricant sump (13) arranged in a bottom area (12) of the compressor housing (2) vertically via the crankshaft (6), when the refrigerant compressor (1) is in an operating state, wherein viewed in a first direction (15) the stator (5) extends from a first stator section (16) to a second stator section (17) and the rotor (4) extends from a first rotor section (22) to a second rotor section (23), wherein the first direction (15) is parallel to the axis of rotation (14) and points from the bottom area (12) to the piston-cylinder unit (7), wherein the crankshaft (6) is partially arranged in a bush-like section (21) of a compressor block (20), wherein, viewed in radial directions (24) normal to the first direction (15) and pointing away from the axis of rotation (14), an interspace (25) is formed between the second stator section (17) and the compressor block (20), in which interspace (25) the second rotor section (23) is arranged at least partially, wherein, viewed in the radial directions (24), a gap (26) is formed between the second rotor section (23) and the compressor block (20), wherein for the lubricant (11) at least one through-hole (27) is provided in the compressor block (20) between the crankshaft (6) and the gap (26), wherein an accumulation volume (35) for accumulating lubricant (11) is provided between a lateral surface (30) of the crankshaft (6) and an inner wall (36) of the bush-like section (21) of the compressor block (20), wherein the accumulation volume (35) is fluidically connected with the at least one through-hole (27), wherein the crankshaft (6) comprises an inner channel (28) for vertically conveying the lubricant (11) within the crankshaft (6) in the operating state of the refrigerant compressor (1), a connection hole (29) fluidically connecting the inner channel (28) with the lateral surface (30) of the crankshaft (6), a helical groove (31) arranged on the lateral surface (30) for further vertically conveying the lubricant (11), wherein, viewed in the first direction (15), the helical groove (31) extends on the lateral surface (30) of the crankshaft (6) from a first surface section (32) via an intermediate surface section (33) to a second surface section (34), with the first, intermediate and second surface sections (32, 33, 34) being arranged in the bush-like section (21) of the compressor block (20), and wherein the accumulation volume (35) for accumulating lubricant (11) is provided only between the intermediate surface section (33) or the intermediate surface section (33) and the second surface section (34) on the one hand and the inner wall (36) of the bush-like section (21) of the compressor block (20) on the other hand.

2. The refrigerant compressor (1) according to claim 1, wherein the at least one through-hole (27) fluidically connects the accumulation volume (35) and the gap (26).

3. The refrigerant compressor (1) according to claim 1, wherein the crankshaft (6) comprises transportation means (28, 29, 31) for transporting the lubricant (11) from the lubricant receptacle (10) to the accumulation volume (35) when the refrigerant compressor (1) is in the operating state.

4. The refrigerant compressor (1) according to claim 1, wherein within the extension of the accumulation volume (35) a maximum diameter (DC) of the crankshaft (6) is smaller and/or a minimum inner diameter (DB) of the bush-like section (21) of the compressor block (20) is greater than in at least one adjacent region.

5. The refrigerant compressor (1) according to claim 1, wherein a maximum diameter (DC) of the crankshaft (6) in the region of the intermediate surface section (33) is smaller than in the region of the first surface section (32).

6. The refrigerant compressor (1) according to claim 1, wherein the rotor (4) comprises a rotor ring (38) arranged in the second rotor section (23), which rotor ring (38) has an inner surface (39) facing toward the crankshaft (6).

7. The refrigerant compressor (1) according to claim 6, wherein a distance (d) measured between the axis of rotation (14) and the inner surface (39) of the rotor ring (38) along the radial directions (24) increases along the first direction (15).

8. The refrigerant compressor (1) according to claim 6, wherein the inner surface (39) of the rotor ring (38) has a beveled and/or curved shape.

9. The refrigerant compressor (1) according to claim 6, wherein lubricant distribution means are provided, which lubricant distribution means are formed by openings (40, 41) in the rotor ring (38) that fluidically connect the gap (26) with the interspace (25), wherein said openings (40, 41) run with a directional component parallel to the radial direction (24).

10. The refrigerant compressor (1) according to claim 9, wherein the openings comprise distribution through-holes (40) that are bounded by the rotor ring (38) in the first direction (15) and/or distribution notches (41) that, viewed in the first direction (15), have an open end.

11. The refrigerant compressor (1) according to claim 6, wherein lubricant distribution means are provided, which lubricant distribution means are formed by spray blades (42) arranged on a top surface (43) of the rotor ring (38), which top surface (43) faces into the first direction (15).

12. The refrigerant compressor (1) according to claim 6, wherein the inner surface (39) of the rotor ring (38) forms at least one pocket (44), breaking a rotational symmetry of the inner surface (39) with respect to the axis of rotation (14).

13. The refrigerant compressor (1) according to claim 1, wherein the stator (5) comprises second stator windings (19) arranged in the second stator section (17).

14. The refrigerant compressor (1) according to claim 5, wherein the maximum diameter (DC) of the crankshaft (6)

in the region of the intermediate surface section (33) is smaller than in the region of the second surface section (34).

* * * * *